US010330302B2

(12) United States Patent
Fu et al.

(10) Patent No.: US 10,330,302 B2
(45) Date of Patent: Jun. 25, 2019

(54) GAS-FREE LIGHT BULB DEVICE

(71) Applicant: XIAMEN ECO LIGHTING CO. LTD., Xiamen (CN)

(72) Inventors: Mingyan Fu, Xiamen (CN); Liangliang Cao, Xiamen (CN); Yongjun Bao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 177 days.

(21) Appl. No.: 15/628,468

(22) Filed: Jun. 20, 2017

(65) Prior Publication Data

US 2018/0347802 A1 Dec. 6, 2018

(30) Foreign Application Priority Data

May 31, 2017 (CN) ..... 2017 1 0401158

(51) Int. Cl.

| | |
|---|---|
| ***F21V 29/50*** | (2015.01) |
| ***F21V 29/73*** | (2015.01) |
| ***F21K 9/232*** | (2016.01) |
| ***F21K 9/238*** | (2016.01) |
| ***F21V 29/10*** | (2015.01) |
| *F21Y 115/10* | (2016.01) |

(52) U.S. Cl.

CPC ..... *F21V 29/73* (2015.01); *F21K 9/232* (2016.08); *F21K 9/238* (2016.08); *F21V 29/10* (2015.01); *F21V 29/50* (2015.01); *F21Y 2115/10* (2016.08)

(58) Field of Classification Search

CPC ..... F21V 29/73; F21V 29/50; F21V 29/10; F21K 9/232; F21K 9/238

USPC ..... 313/271–274; 362/373

See application file for complete search history.

(56) References Cited

U.S. PATENT DOCUMENTS

| | | | | |
|---|---|---|---|---|
| 2,007,919 | A * | 7/1935 | Braselton | H01J 61/64 313/344 |
| 2016/0363267 | A1* | 12/2016 | Jiang | F21V 29/70 |
| 2017/0016582 | A1* | 1/2017 | Yang | F21K 9/232 |
| 2017/0191623 | A1* | 7/2017 | Ma | F21K 9/237 |
| 2017/0276298 | A1* | 9/2017 | Liu | F21V 19/005 |

FOREIGN PATENT DOCUMENTS

GB 2561145 A * 10/2018

* cited by examiner

*Primary Examiner* — Karabi Guharay

(74) *Attorney, Agent, or Firm* — Chun-Ming Shih

(57) ABSTRACT

A gas-free light bulb device has a lamp head, heatsink, a bulb, a glass core column, multiple filament assemblies, and a resilient extending element. The heatsink is mounted on the lamp head and has a mounting slot and a driver circuit board mounted in the mounting slot. The bulb is mounted on the heatsink and has a cavity. The glass core column is mounted in the mounting slot. The filament assemblies are mounted on the glass core column. The resilient extending element is mounted on the glass core and has a resilient rubber sleeve mounted around the glass core column and multiple resilient extending rubber bars connected respectively to the filament assemblies. When the gas-free light bulb device is operated with rising temperature, the resilient rubber sleeve is heated and loosened to slide upward and drive the filament assemblies to contact the bulb to effectively dissipate heat.

20 Claims, 10 Drawing Sheets

GAS-FREE LIGHT BULB DEVICE

BACKGROUND OF THE INVENTION

1. Field of the Invention

The present invention relates to a light bulb device, and more particularly to a gas-free light bulb device that has filaments heat-dissipating through a glass bulb, the glass bulb has a sufficient large surface area such that the heat convection effect of the glass bulb with ambient air is excellent. With assistance of a heatsink, the heat dissipation efficiency of the glass bulb allows the gas-free light bulb device to be fabricated without gas filling and aluminum elements. Therefore, the gas-free light bulb device has a lower manufacturing cost when compared to conventional gas-free light bulb devices in the market.

2. Description of Related Art

Conventional tungsten light bulb devices has undesirable high temperature-rising rate due to low manufacturing cost. When the tungsten filaments inside the light bulb devices is heated under an incandescent status with high temperate the tungsten filaments vaporizes excessively fast and a lifespan thereof is greatly lowered. Furthermore, the vaporized tungsten is deposited and accumulated on an inner surface of the bulb and darkens the bulb, which negatively affects the illumination of the operating light bulb device. As a result, the lifespan of the light bulb device is decreased or failure rate of the light bulb device is undesirably high.

Conventional gas-filled light bulb devices are also be sold in the market and bulbs thereof are filled with inert gas, which excellently decreases the vaporization rate of its tungsten filaments in the inert gas environment when compared to the vacuum environment. In other words, under the same lifespan condition, operating temperature the tungsten filaments of such gas-filled light bulb device may be higher than the operating temperature of the vacuum environment. Therefore, after vacuumed, the bulb of gas-filled light bulb device is filled with argon gas, nitrogen gas or mixture thereof with a specific pressure.

Although the aforementioned gas-filled light bulb device is able to excellently solve the issues of high temperature rising rate or overheated problems, such gas-filled light bulb device has higher manufacturing cost and is therefore more expensive.

Conventional gas-free light bulb device has been developed to replace conventional tungsten filaments with filament-shaped light emitting diode (LED) modules. Because LEDs generates considerable heat, aluminum heatsinks are primarily employed to assist heat dissipation, which results in increase of manufacturing cost of the gas-free light bulb device. Therefore the gas-free light bulb device would not prevail over the aforementioned gas-filled light bulb device in cost.

To overcome the shortcomings, the present invention provides a gas-free light bulb device to mitigate or obviate the aforementioned problems.

SUMMARY OF THE INVENTION

The main objective of the invention is to provide a gas-free light bulb device that has filaments heat-dissipating through a glass bulb, the glass bulb has a sufficient large surface area such that the heat convection effect of the glass bulb with ambient air is excellent. With assistance of a heatsink, the heat dissipation efficiency of the glass bulb allows the gas-free light bulb device to be fabricated without gas filling and aluminum elements. Therefore, the gas-free light bulb device has a lower manufacturing cost when compared to conventional gas-free light bulb devices in the market.

A gas-free light bulb device in accordance with the present invention comprises: a lamp head;

a heatsink mounted on the lamp head and having a mounting slot defined in the heatsink; and a driver circuit board mounted in the mounting slot; a bulb mounted on the heatsink and having a cavity defined in the bulb; a glass core column mounted in the mounting slot of the heatsink and extending in the cavity of the bulb; multiple filament assemblies suspended on the glass core column and indirectly electrically connected to the driver circuit board; and a resilient extending element mounted on the glass core column and having a resilient rubber sleeve mounted around the glass core column, wherein a thermal expansion coefficient of the resilient rubber sleeve is higher than a thermal expansion coefficient of the glass core column; and multiple resilient extending rubber bars formed on and protruding radially outward from the resilient rubber sleeve and corresponding to the multiple filament assemblies, and an outer end of each resilient extending rubber bar connected to a corresponding filament assembly. When the gas-free light bulb device is not operated under room temperature, an inner diameter of the resilient rubber sleeve is not larger than an outer diameter of the glass core column such that the resilient rubber sleeve is mounted tightly on a lower position of the glass core column and is unable to slide, at the meantime, the resilient extending rubber bars are curved and apply resilient force to the filament assemblies and the resilient rubber sleeve. When the gas-free light bulb device is operated with rising temperature, the resilient rubber sleeve is heated and expanded to make the inner diameter larger than the outer diameter of the glass core column, at the meantime, the resilient rubber sleeve is loosened relative to the glass core column, and resilient force of the resilient extending rubber bar drives the resilient rubber sleeve to slide upward along the glass core column to an upper position of the glass core column and to pivot the multiple filament assemblies upward relative to the glass core column until the bottom end of each filament assembly contacts the bulb an inner wall of the cavity and conducts heat of each filament assembly to the bulb.

Another gas-free light bulb device in accordance with the present invention comprises: a lamp head; a heatsink mounted on the lamp head and having a mounting slot defined in the heatsink; and a driver circuit board mounted in the mounting slot; a bulb mounted on the heatsink and having a cavity defined in the bulb; a glass core column mounted in the mounting slot of the heatsink and extending in the cavity of the bulb; multiple filament assemblies suspended on the glass core column and indirectly electrically connected to the driver circuit board; and a resilient extending element mounted on the glass core column and having a resilient rubber sleeve mounted around the glass core column, wherein a thermal expansion coefficient of the resilient rubber sleeve is higher than a thermal expansion coefficient of the glass core column; and multiple resilient extending rubber bars formed on and protruding radially outward from the resilient rubber sleeve and corresponding to the multiple filament assemblies, and an outer end of each resilient extending rubber bar connected to a corresponding filament assembly; wherein, when the gas-free light bulb device is not operated under room temperature, an inner diameter of the resilient rubber sleeve is not larger than an outer diameter of the glass core column such that the resilient rubber sleeve is mounted tightly on a lower position of the glass core column and is unable to slide, at the meantime, the resilient extending rubber bars are curved and apply resilient force to the filament assemblies and the resilient rubber sleeve.

Still another gas-free light bulb device in accordance with the present invention comprises: a lamp head; a heatsink mounted on the lamp head and having a mounting slot defined in the heatsink; and a driver circuit board mounted in the mounting slot; a bulb mounted on the heatsink and having a cavity defined in the bulb; a glass core column mounted in the mounting slot of the heatsink and extending in the cavity of the bulb; multiple filament assemblies suspended on the glass core column and indirectly electrically connected to the driver circuit board; and a resilient extending element mounted on the glass core column and having a resilient rubber sleeve mounted around the glass core column, wherein a thermal expansion coefficient of the resilient rubber sleeve is higher than a thermal expansion coefficient of the glass core column; and multiple resilient extending rubber bars formed on and protruding radially outward from the resilient rubber sleeve and corresponding to the multiple filament assemblies, and an outer end of each resilient extending rubber bar connected to a corresponding filament assembly; wherein, when the gas-free light bulb device is operated with rising temperature, the resilient rubber sleeve is heated and expanded to make an inner diameter of the resilient rubber sleeve larger than an outer diameter of the glass core column, at the meantime, the resilient rubber sleeve is loosened relative to the glass core column, and resilient force of the resilient extending rubber bar drives the resilient rubber sleeve to slide upward along the glass core column to an upper position of the glass core column and to pivot the multiple filament assemblies upward relative to the glass core column until the bottom end of each filament assembly contacts the bulb an inner wall of the cavity and conducts heat of each filament assembly to the bulb.

The present invention comprises the following advantages.

1. The gas-free light bulb device of the present invention employs the filament-shaped LED modules instead of tungsten filaments that will vaporize. Therefore, no need of filling inert gas in to the bulb, which decreases the manufacturing cost of the gas-free light bulb device.

2. After the gas-free light bulb device is operated and heated, through contact between of the multiple filament assemblies and the inner wall of the cavity of the bulb, the heat of the multiple filament assemblies is conducted to the bulb. A further thermal exchange is between the bulb and ambient air would bring the heat from the bulb. Therefore, the gas-free light bulb device of the present invention has better heat dissipation function and longer lifespan when compared to conventional light bulbs.

3. The resilient extending element only provides resilient force by rubber material without any mechanically connected components such that mechanic wearing and failure are obviated.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
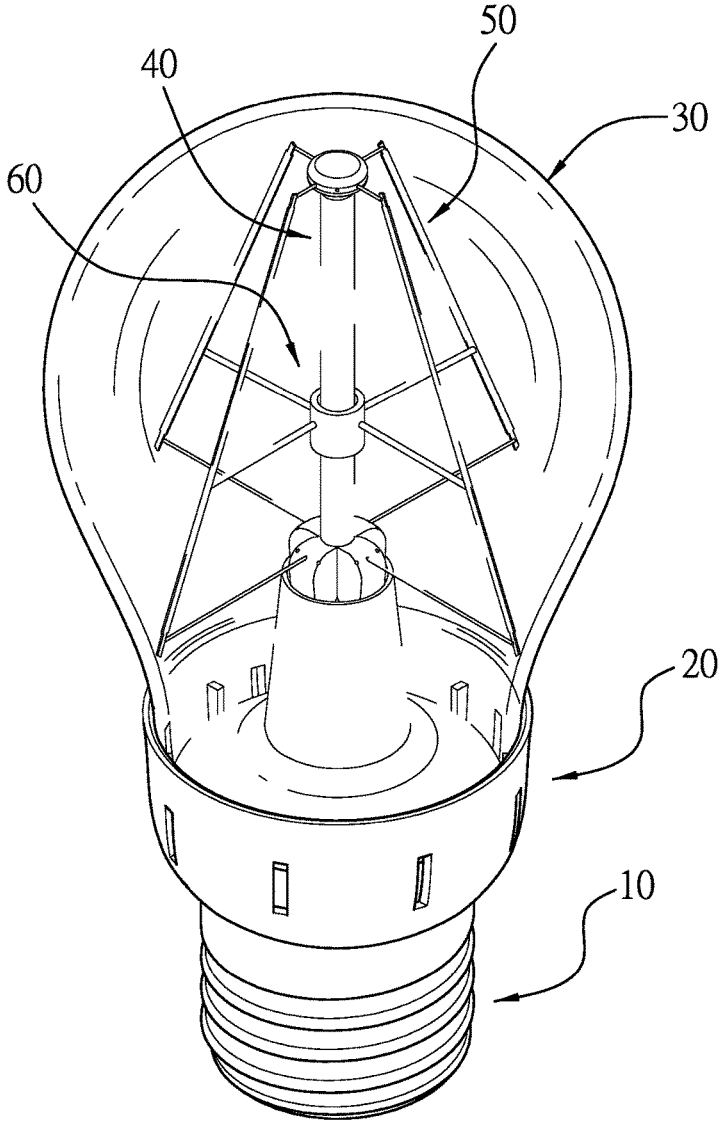
FIG. 1 is a perspective view of a first embodiment of a gas-free light bulb device in accordance with the present invention.
Figure 2:
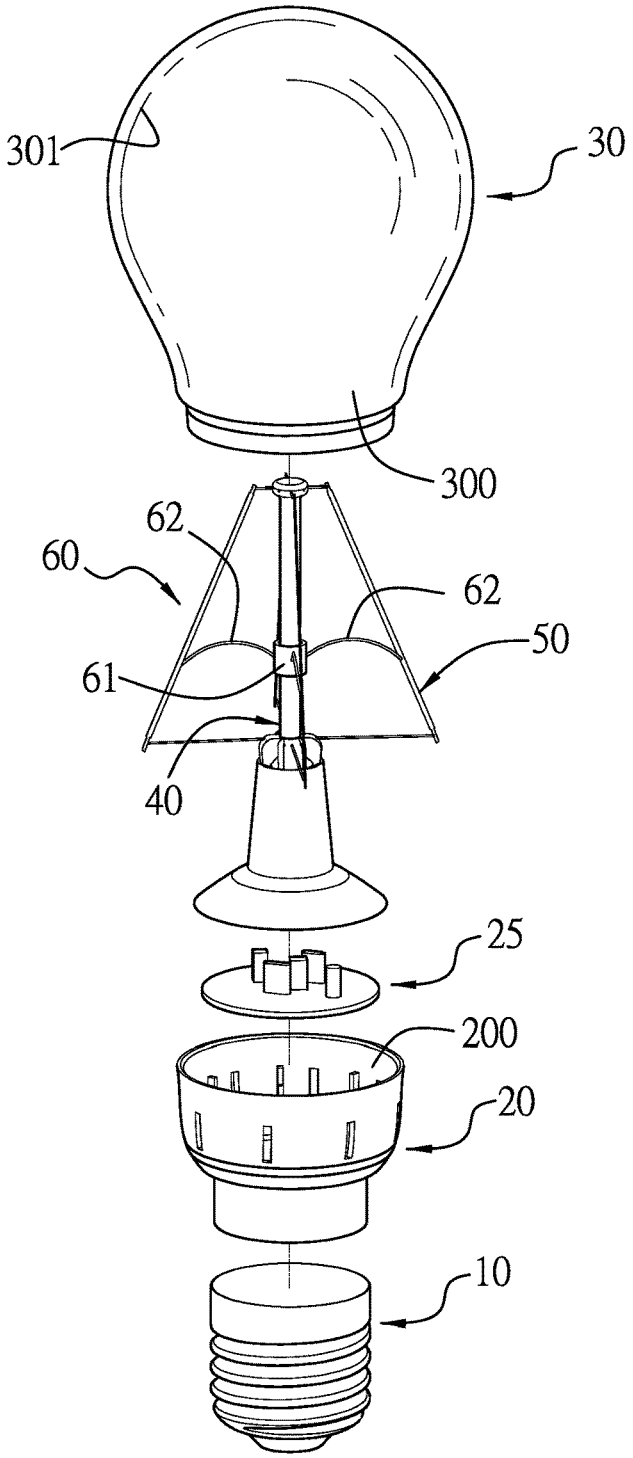
FIG. 2 is an exploded perspective view of the gas-free light bulb device in FIG. 1.
Figure 3:
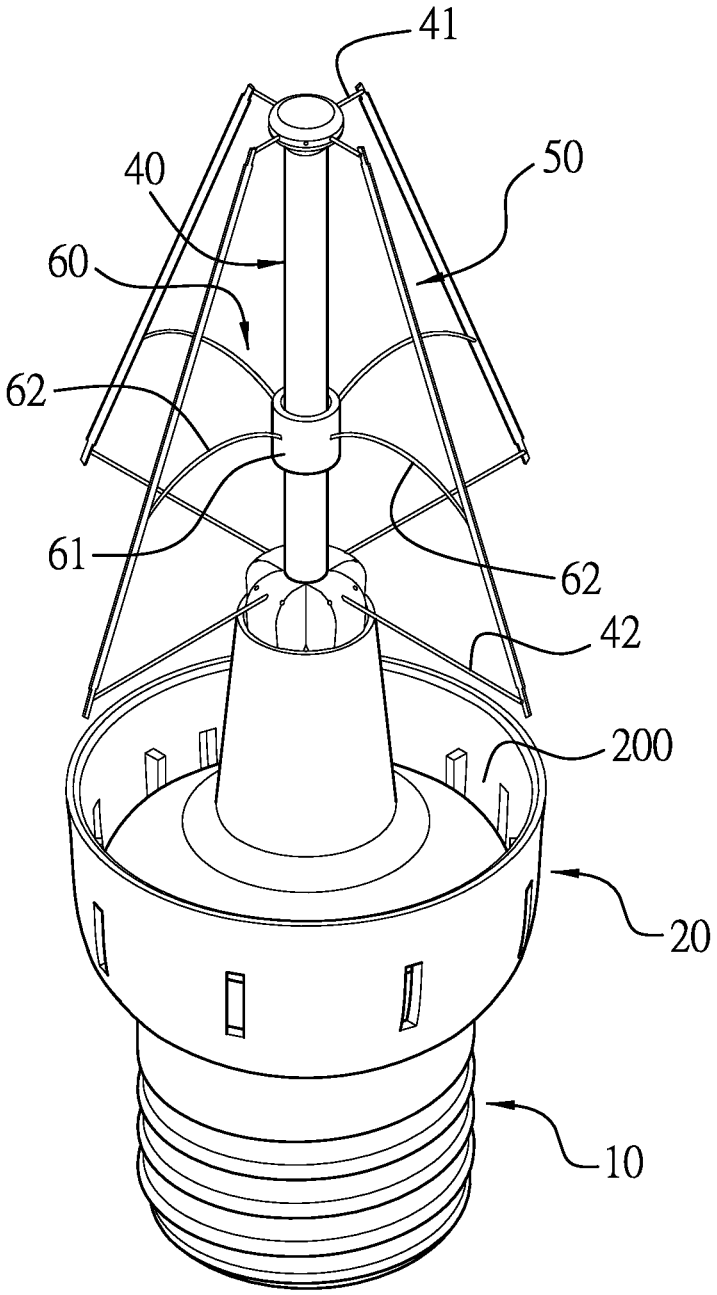
FIG. 3 is a perspective view of the gas-free light bulb device in FIG. 1 omitting a bulb.

With reference to FIGS. 1 to 3, a first embodiment of a gas-free light bulb device in accordance with present invention comprises a lamp head 10, heatsink 20, a bulb 30, a glass core column 40, multiple filament assemblies 50, and a resilient extending element.

The lamp head 10 may be connected to an indoor bulb socket. Furthermore, the lamp head 10 mad be made of metal. Preferably, the lamp head may be made of aluminum or copper.

The heatsink 20 is mounted on the lamp head 10 and has a mounting slot 200 and a driver circuit board 25. The mounting slot 200 is defined in the heatsink 20. The driver circuit board 25 is mounted in the mounting slot 200.

The bulb 30 is mounted on the heatsink 20 and has a cavity 300. The cavity 300 is defined in the bulb 30. Furthermore, the heatsink 20 may be made of metal. Preferably, the heatsink 20 may be made of metal such as steel, aluminum or copper and may be made of plastic.

Figure 4:
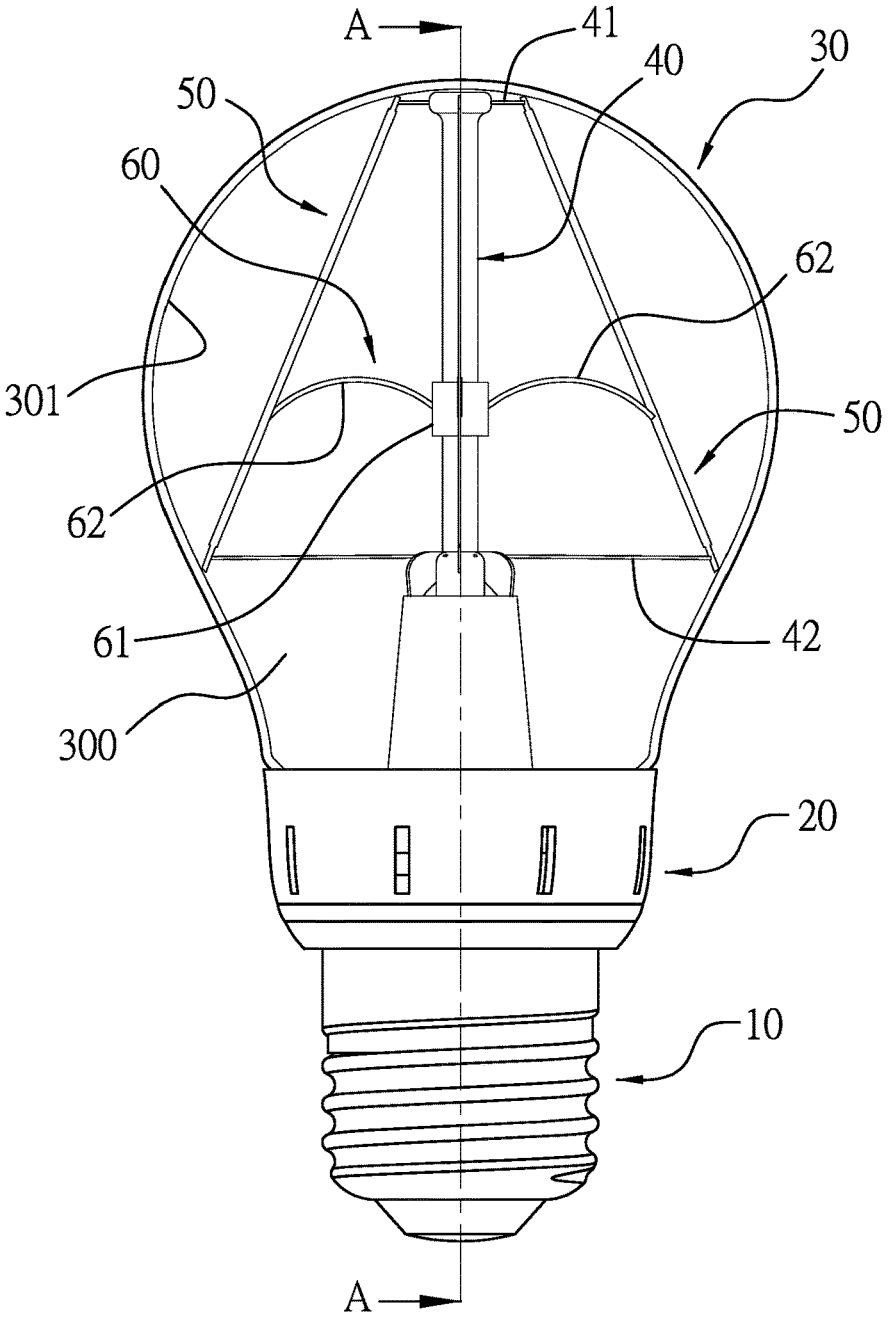
FIG. 4 is a front view of the gas-free light bulb device in FIG. 1.
Figure 5:
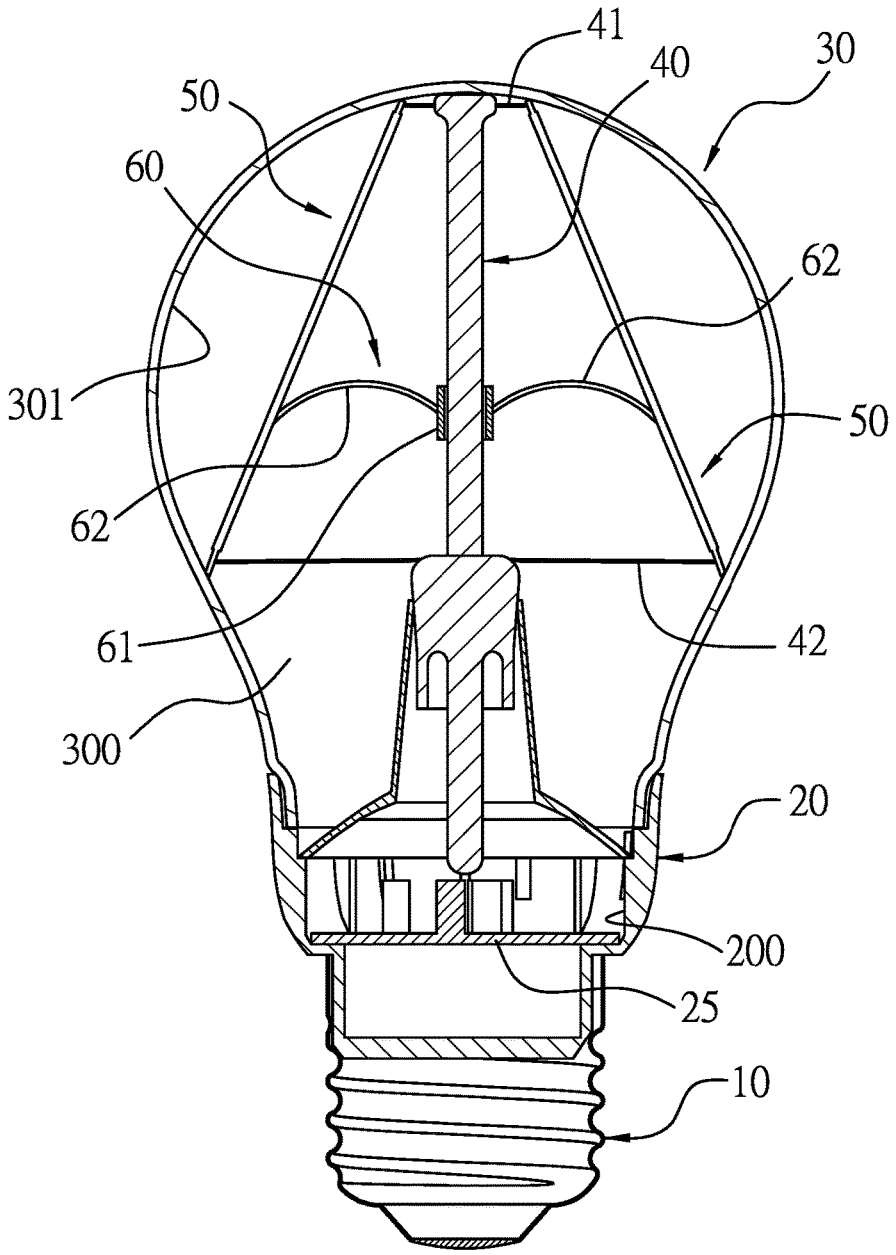
FIG. 5 is a cross sectional front view of the gas-free light bulb device along line A-A in FIG. 4.

With further reference to FIGS. 4 and 5, the glass core column 40 is mounted in the mounting slot 200 of the heatsink 20, extends in the cavity 300 of the bulb 30, is electrically connected to the driver circuit board 25 and has multiple wire sets mounted on the glass core column 40. Each wire set has an upper core wire 41 and a lower core wire 42. The upper core wire 41 is mounted on a top end of the glass core column 40. The lower core wire 42 is mounted on a bottom end of the glass core column 40.

The multiple filament assemblies 50 are suspended on the glass core column 40, is electrically connected to the glass core column 40 and is indirectly electrically connected to the driver circuit board 25. Preferably, the multiple filament assemblies 50 correspond to and are connected respectively to the wire sets of the glass core column 40. A top end of each filament assembly 50 is connected to the upper core wire 41 of a corresponding wire set. A bottom end of each filament assembly 50 is connected to the lower core wire 42 of the corresponding wire set. Furthermore, each filament assembly 50 may be a filament-shaped LED module and has at least one LED.

The resilient extending element 60 is mounted on the glass core column 40 and has a resilient rubber sleeve 61 and multiple resilient extending rubber bars 62. The resilient rubber sleeve 61 is mounted around the glass core column 40, and a thermal expansion coefficient of the resilient rubber sleeve 61 is higher than a thermal expansion coefficient of the glass core column 40. The multiple resilient extending rubber bars 62 are formed on and protrude radially outward from the resilient rubber sleeve 61 and correspond to the multiple filament assemblies 50. An outer end of each resilient extending rubber bar 62 is connected to a corresponding filament assembly 50.

Figure 6:
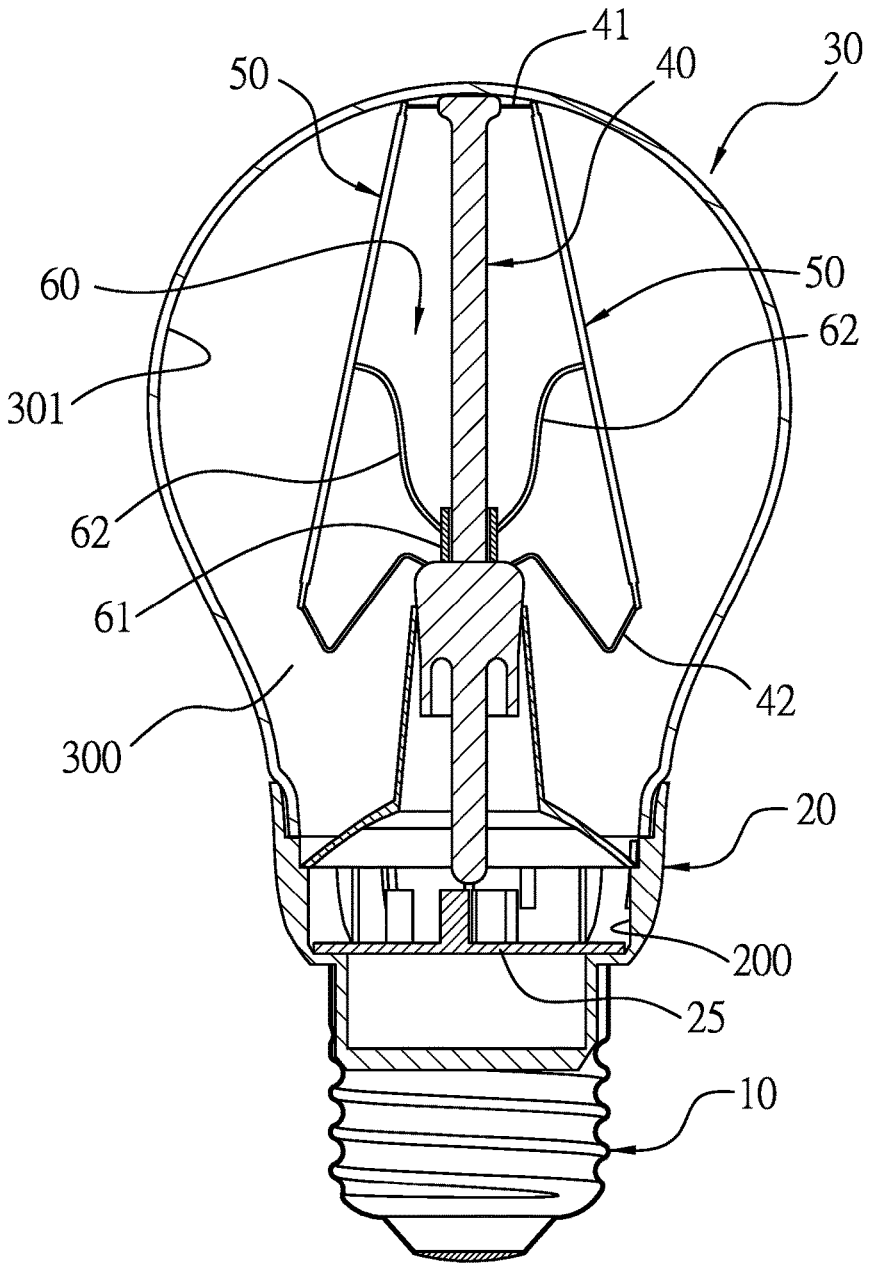
FIG. 6 is a cross sectional view of the gas-free light bulb device in FIG. 1 not operated in a lower temperature.

With further reference to FIG. 6, when the gas-free light bulb device is not operated under room temperature, an inner diameter of the resilient rubber sleeve 61 is not larger than an outer diameter of the glass core column 40 such that the resilient rubber sleeve 61 is mounted tightly on a lower position of the glass core column 40 and is unable to slide. At the meantime, the resilient extending rubber bars 62 are curved and apply resilient force to the filament assemblies 50 and the resilient rubber sleeve 61.

Figure 7:
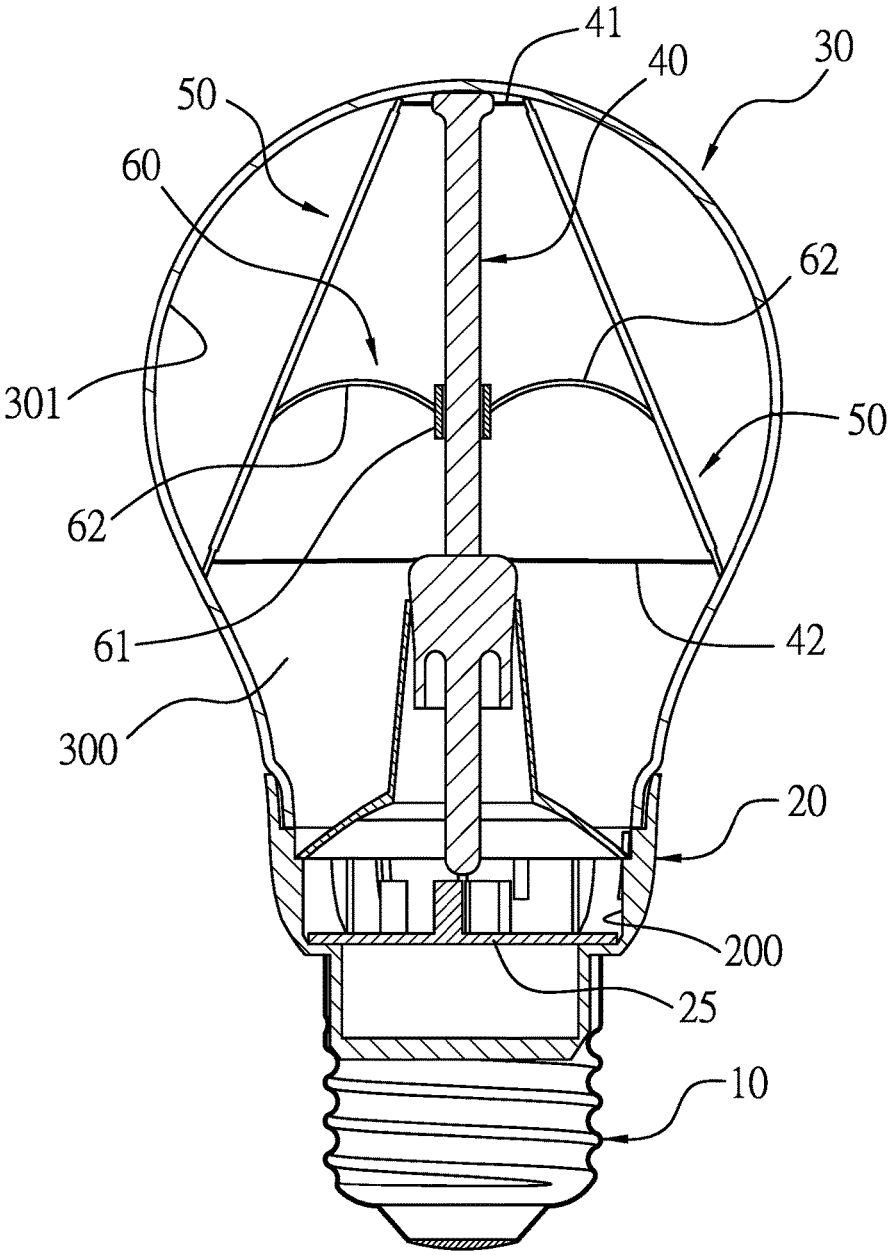
FIG. 7 is an operational cross sectional front view of the gas-free light bulb device in FIG. 7 operated with a raised temperature.

With further reference to FIG. 7, when the gas-free light bulb device is operated with rising temperature, the resilient rubber sleeve 61 is heated and expanded to make the inner diameter larger than the outer diameter of the glass core column 40. At the meantime, the resilient rubber sleeve 61 is loosened relative to the glass core column 40, and resilient force of the resilient extending rubber bar 62 drives the resilient rubber sleeve 61 to slide upward along the glass core column 40 to an upper position of the glass core column 40 and to pivot the multiple filament assemblies 50 upward relative to the glass core column 40 until the bottom end of each filament assembly 50 contacts the bulb 30 an inner wall 301 of the cavity 300 and conducts heat of each filament assembly 50 to the bulb 30.

Figure 8:
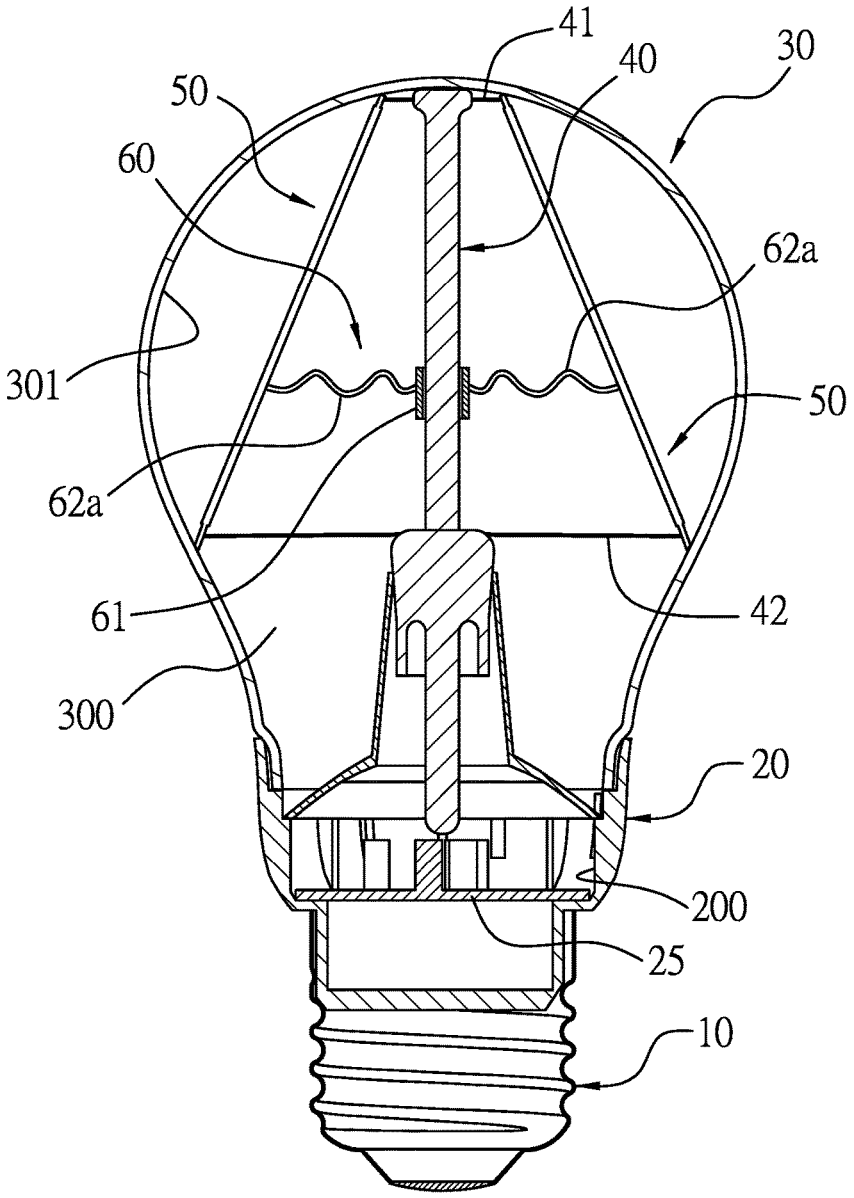
FIG. 8 is a cross sectional front view of a second embodiment of the gas-free light bulb device in accordance with the present invention.

With further reference to FIG. 8, a second embodiment of the gas-free light bulb device in accordance with the present invention is similar to the first embodiment and comprises: a lamp head 10, a heatsink a 20, a bulb 30, a glass core column 40, multiple filament assemblies 50 and a resilient extending element 60. The lamp head 10 may be connected to an indoor bulb socket. Furthermore, the lamp head 10 may be made of metal. Preferably, the lamp head may be made of aluminum or copper. The heatsink 20 is mounted on the lamp head 10 and has a mounting slot 200 and a driver circuit board 25. The mounting slot 200 is defined in the heatsink 20. The driver circuit board 25 is mounted in the mounting slot 200. The bulb 30 is mounted on the heatsink 20 and has a cavity 300. The cavity 300 is defined in the bulb 30. Furthermore, the heatsink 20 may be made of metal. Preferably, the heatsink 20 may be made of steel, aluminum or copper. The glass core column 40 is mounted in the mounting slot 200 of the heatsink 20, extends in the cavity 300 of the bulb 30, is electrically connected to the driver circuit board 25 and has multiple wire sets mounted on the glass core column 40. Each wire set has an upper core wire 41 and a lower core wire 42. The upper core wire 41 is mounted on a top end of the glass core column 40. The lower core wire 42 is mounted on a bottom end of the glass core column 40. The multiple filament assemblies 50 are suspended on the glass core column 40, is electrically connected to the glass core column 40 and is indirectly electrically connected to the driver circuit board 25. Preferably, the multiple filament assemblies 50 correspond to and are connected respectively to the wire sets of the glass core column 40. A top end of each filament assembly 50 is connected to the upper core wire 41 of a corresponding wire set. A bottom end of each filament assembly 50 is connected to the lower core wire 42 of the corresponding wire set. Furthermore, each filament assembly 50 may be a filament-shaped LED module and has at least one LED. The resilient extending element 60 is mounted on the glass core column 40 and has a resilient rubber sleeve 61 and multiple resilient extending rubber bars 62*a*. The resilient rubber sleeve 61 is mounted around the glass core column 40, and a thermal expansion coefficient of the resilient rubber sleeve 61 is higher than that of the glass core column 40. The multiple resilient extending rubber bars 62*a* protrude radially from the resilient rubber sleeve 61 and correspond to the multiple filament assemblies 50. An outer end of each resilient extending rubber bar 62*a* is connected to a corresponding filament assembly 50.

The difference of the second embodiment is that each resilient extending rubber bar 62*a* has multiple wave-shaped resilient portions formed on the resilient extending rubber bar 62*a* and connected to one another. The wave-shaped resilient portions selectively compress or stretch.

Figure 9:
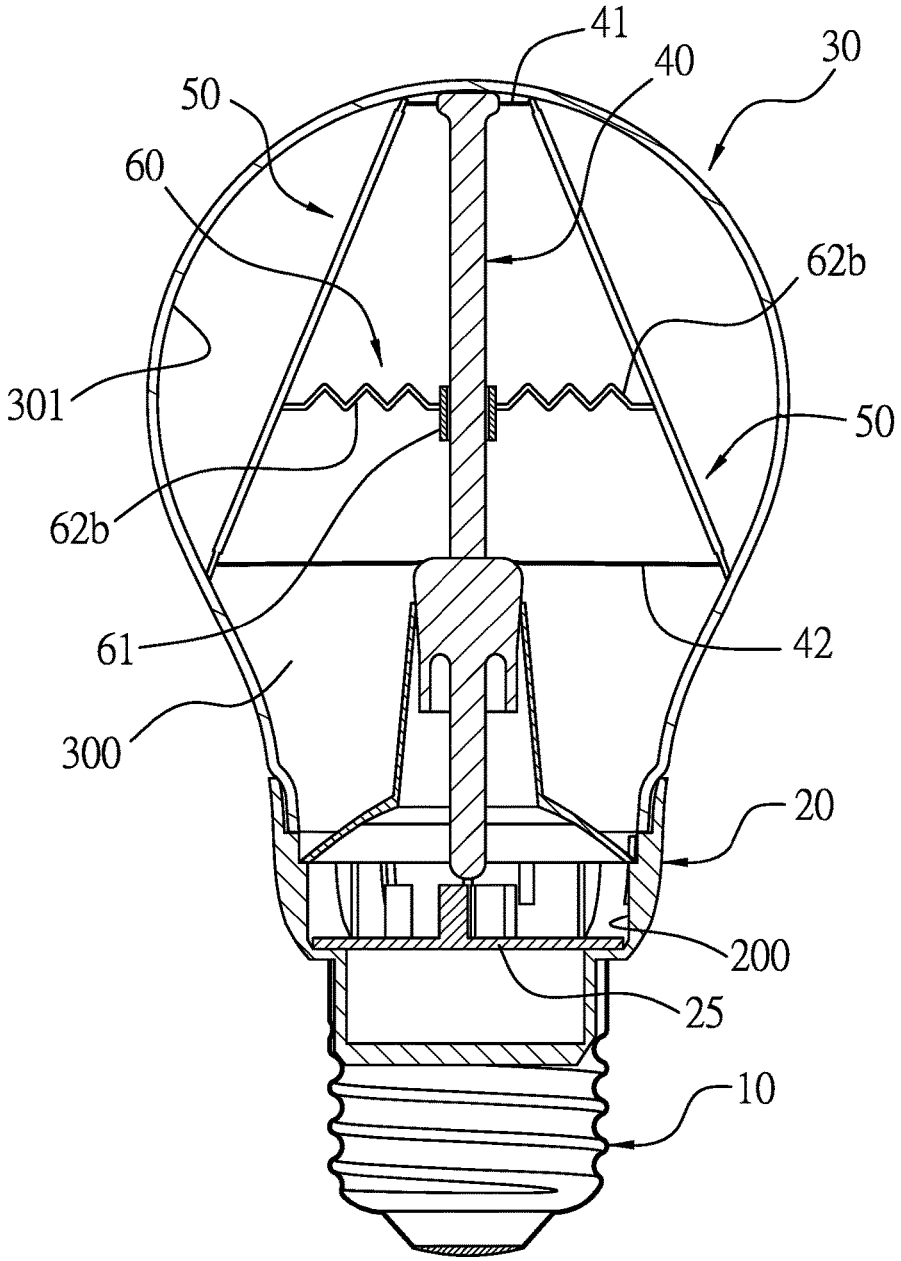
FIG. 9 is a cross sectional front view of a third embodiment of the gas-free light bulb device in accordance with the present invention.

With further reference to FIG. 9, a third embodiment of the gas-free light bulb device in accordance with the present invention is similar to the first embodiment and comprises: a lamp head 10, a heatsink a 20, a bulb 30, a glass core column 40, multiple filament assemblies 50 and a resilient extending element 60. The lamp head 10 may be connected to an indoor bulb socket. Furthermore, the lamp head 10 mad be made of metal. Preferably, the lamp head may be made of aluminum or copper. The heatsink 20 is mounted on the lamp head 10 and has a mounting slot 200 and a driver circuit board 25. The mounting slot 200 is defined in the heatsink 20. The driver circuit board 25 is mounted in the mounting slot 200. The bulb 30 is mounted on the heatsink 20 and has a cavity 300. The cavity 300 is defined in the bulb 30. Furthermore, the heatsink 20 may be made of metal. Preferably, the heatsink 20 may be made of steel, aluminum or copper. The glass core column 40 is mounted in the mounting slot 200 of the heatsink 20, extends in the cavity 300 of the bulb 30, is electrically connected to the driver circuit board 25 and has multiple wire sets mounted on the glass core column 40. Each wire set has an upper core wire 41 and a lower core wire 42. The upper core wire 41 is mounted on a top end of the glass core column 40. The lower core wire 42 is mounted on a bottom end of the glass core column 40. The multiple filament assemblies 50 are suspended on the glass core column 40, is electrically connected to the glass core column 40 and is indirectly electrically connected to the driver circuit board 25. Preferably, the multiple filament assemblies 50 correspond to and are connected respectively to the wire sets of the glass core column 40. A top end of each filament assembly 50 is connected to the upper core wire 41 of a corresponding wire set. A bottom end of each filament assembly 50 is connected to the lower core wire 42 of the corresponding wire set. Furthermore, each filament assembly 50 may be a filament-shaped LED module and has at least one LED. The resilient extending element 60 is mounted on the glass core column 40 and has a resilient rubber sleeve 61 and multiple resilient extending rubber bars 62*b*. The resilient rubber sleeve 61 is mounted around the glass core column 40, and a thermal expansion coefficient of the resilient rubber sleeve 61 is higher than that of the glass core column 40. The multiple resilient extending rubber bars 62*b* protrude radially from the resilient rubber sleeve 61 and correspond to the multiple filament assemblies 50. An outer end of each resilient extending rubber bar 62*b* is connected to a corresponding filament assembly 50.

The difference of the third embodiment is that each resilient extending rubber bar 62*b* has multiple Z-shaped resilient portions formed on the resilient extending rubber bar 62*b* and connected to one another. The Z-shaped resilient portions selectively compress or stretch.

Figure 10:
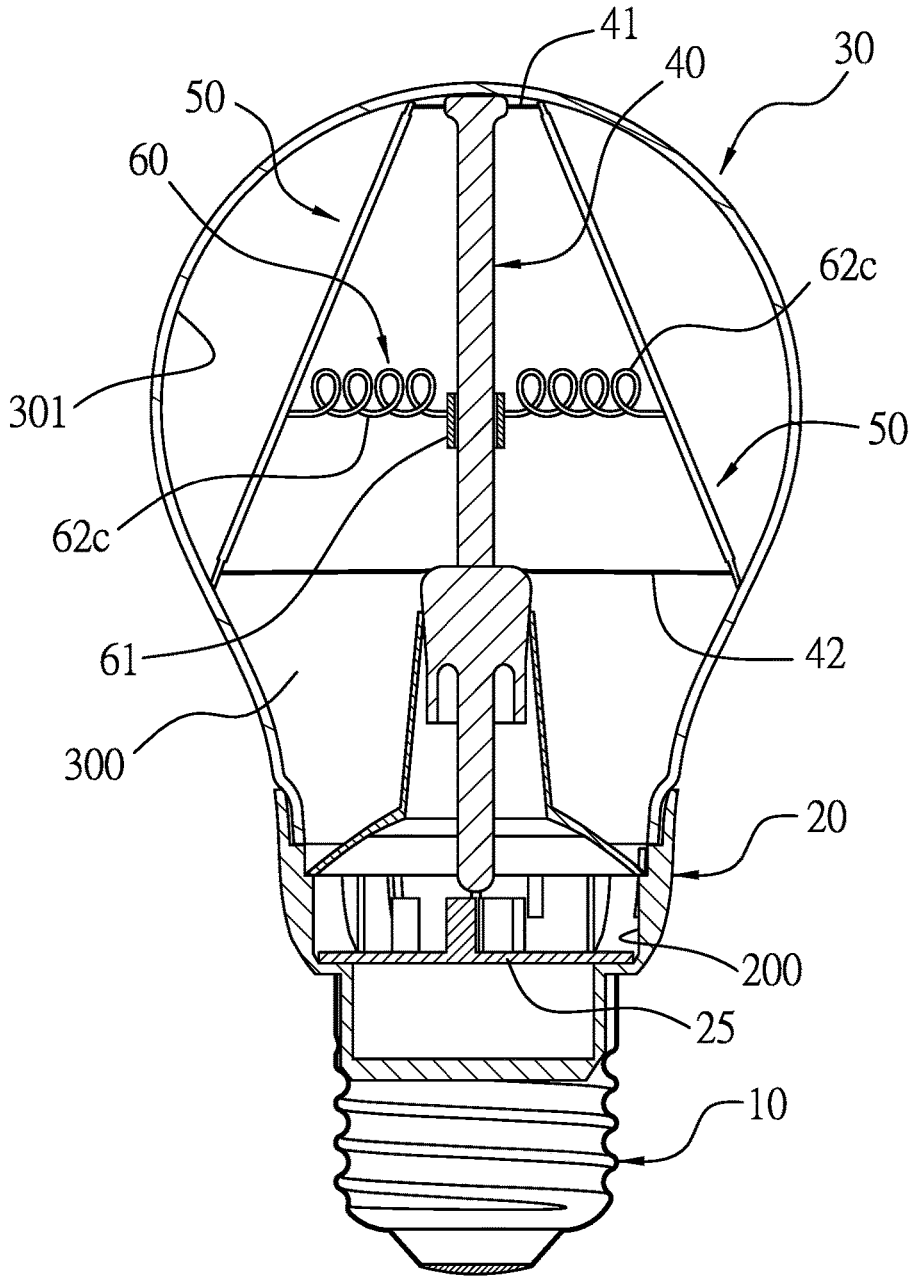
FIG. 10 is a cross sectional front view of a fourth embodiment of the gas-free light bulb device in accordance with the present invention.

With further reference to FIG. 10, a fourth embodiment of the gas-free light bulb device in accordance with the present invention is similar to the first embodiment and comprises: a lamp head 10, a heatsink a 20, a bulb 30, a glass core column 40, multiple filament assemblies 50 and a resilient extending element 60. The lamp head 10 may be connected to an indoor bulb socket. Furthermore, the lamp head 10 mad be made of metal. Preferably, the lamp head may be made of aluminum or copper. The heatsink 20 is mounted on the lamp head 10 and has a mounting slot 200 and a driver circuit board 25. The mounting slot 200 is defined in the heatsink 20. The driver circuit board 25 is mounted in the mounting slot 200. The bulb 30 is mounted on the heatsink 20 and has a cavity 300. The cavity 300 is defined in the bulb 30. Furthermore, the heatsink 20 may be made of metal. Preferably, the heatsink 20 may be made of steel, aluminum or copper. The glass core column 40 is mounted in the mounting slot 200 of the heatsink 20, extends in the cavity 300 of the bulb 30, is electrically connected to the driver circuit board 25 and has multiple wire sets mounted on the glass core column 40. Each wire set has an upper core wire 41 and a lower core wire 42. The upper core wire 41 is mounted on a top end of the glass core column 40. The lower core wire 42 is mounted on a bottom end of the glass core column 40. The multiple filament assemblies 50 are suspended on the glass core column 40, is electrically connected to the glass core column 40 and is indirectly electrically connected to the driver circuit board 25. Preferably, the multiple filament assemblies 50 correspond to and are connected respectively to the wire sets of the glass core column 40. A top end of each filament assembly 50 is connected to the upper core wire 41 of a corresponding wire set. A bottom end of each filament assembly 50 is connected to the lower core wire 42 of the corresponding wire set. Furthermore, each filament assembly 50 may be a filament-shaped LED module and has at least one LED. The resilient extending element 60 is mounted on the glass core column 40 and has a resilient rubber sleeve 61 and multiple resilient extending rubber bars 62*c*. The resilient rubber sleeve 61 is mounted around the glass core column 40, and a thermal expansion coefficient of the resilient rubber sleeve 61 is higher than that of the glass core column 40. The multiple resilient extending rubber bars 62*c* protrude radially from the resilient rubber sleeve 61 and correspond to the multiple filament assemblies 50. An outer end of each resilient extending rubber bar 62*c* is connected to a corresponding filament assembly 50.

The difference of the fourth embodiment is that each resilient extending rubber bar 62*c* has a spiral resilient portion formed on the resilient extending rubber bar 62*c*. The spiral resilient portion selectively compresses or stretches.

By the aforementioned features, the resilient extending element 60 connected to the multiple filament assemblies 50 of the gas-free light bulb device is capable of controlling the filament assemblies 50 to contact the inner wall of the bulb 30. When gas-free light bulb device is non-operated under the room temperature, the resilient rubber sleeve 61 is mounted tightly around the glass core column 40. A friction between the resilient rubber sleeve 61 and the glass core column 40 is larger than the resilient force of the multiple resilient extending rubber bars 62 such that the multiple filament assemblies 50 would not contact the inner wall 301 of the cavity 300 of the bulb 30 in advance. When the gas-free light bulb device is installed to a bulb socket and operated to raise the temperature thereof over a specific value, the resilient rubber sleeve 61 with a higher thermal expansion coefficient is loosened relative to the glass core column 40. The tightened and curved resilient extending rubber bars 62 drive the resilient rubber sleeve 61 to slide upward and simultaneously extend all of the filament assemblies 50 such that the bottom ends of the filament assemblies contact the inner wall 301 of the cavity 300 of the bulb 30 cavity 300.

The present invention comprises the following advantages.

1. The gas-free light bulb device of the present invention employs the filament-shaped LED modules instead of tungsten filaments that will vaporize. Therefore, no need of filling inert gas in to the bulb, which decreases the manufacturing cost of the gas-free light bulb device.

2. After the gas-free light bulb device is operated and heated, through contact between of the multiple filament assemblies 50 and the inner wall 301 of the cavity 300 of the bulb 30, the heat of the multiple filament assemblies 50 is conducted to the bulb 30. A further thermal exchange is between the bulb 30 and ambient air would bring the heat from the bulb 30. Therefore, the gas-free light bulb device of the present invention has better heat dissipation function and longer lifespan when compared to conventional light bulbs.

3. The resilient extending element 60 only provides resilient force by rubber material without any mechanically connected components such that mechanic wearing and failure are obviated.

4. Wave-shaped resilient portions, Z-shaped resilient portions and spiral resilient portions further improve the resilient force of the resilient extending rubber bar 62, which ensures that the bottom ends of filament assemblies 50 contact the inner wall 301 of the cavity 300 of the bulb 30.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A gas-free light bulb device comprising:

a lamp head;

a heatsink mounted on the lamp head and having
- a mounting slot defined in the heatsink; and
- a driver circuit board mounted in the mounting slot;

a bulb mounted on the heatsink and having a cavity defined in the bulb;

a glass core column mounted in the mounting slot of the heatsink and extending in the cavity of the bulb;

multiple filament assemblies suspended on the glass core column indirectly electrically connected to the driver circuit board; and a resilient extending element mounted on the glass core column and having
- a resilient rubber sleeve mounted around the glass core column, wherein a thermal expansion coefficient of the resilient rubber sleeve is higher than a thermal expansion coefficient of the glass core column; and
- multiple resilient extending rubber bars formed on and protruding radially outward from the resilient rubber sleeve and corresponding to the multiple filament assemblies, and an outer end of each resilient extending rubber bar connected to a corresponding filament assembly;

wherein, when the gas-free light bulb device is not operated under room temperature, an inner diameter of the resilient rubber sleeve is not larger than an outer diameter of the glass core column such that the resilient rubber sleeve is mounted tightly on a lower position of the glass core column and is unable to slide, at the meantime, the resilient extending rubber bars are curved and apply resilient force to the filament assemblies and the resilient rubber sleeve;

wherein, when the gas-free light bulb device is operated with rising temperature, the resilient rubber sleeve is heated and expanded to make the inner diameter larger than the outer diameter of the glass core column, at the meantime, the resilient rubber sleeve is loosened relative to the glass core column, and resilient force of the resilient extending rubber bar drives the resilient rubber sleeve to slide upward along the glass core column to an upper position of the glass core column and to pivot the multiple filament assemblies upward relative to the glass core column until the bottom end of each filament assembly contacts the bulb an inner wall of the cavity and conducts heat of each filament assembly to the bulb.

2. The gas-free light bulb device as claimed in claim 1, wherein the glass core column has multiple wire sets mounted on the glass core column and corresponding to the multiple filament assemblies, and each wire set having an upper core wire mounted on a top end of the glass core column and connected to a top end of a corresponding filament assembly; and a lower core wire mounted on a bottom end of the glass core column and connected to a bottom end of the corresponding filament assembly.

3. The gas-free light bulb device as claimed in claim 1, wherein each resilient extending rubber bar has multiple wave-shaped resilient portions formed on the resilient extending rubber bar and connected to one another, and the wave-shaped resilient portions selectively compress or stretch.

4. The gas-free light bulb device as claimed in claim 1, wherein each resilient extending rubber bar has multiple Z-shaped resilient portions formed on the resilient extending rubber bar and connected to one another, and the Z-shaped resilient portions selectively compress or stretch.

5. The gas-free light bulb device as claimed in claim 1, wherein each resilient extending rubber bar has a spiral resilient portion formed on the resilient extending rubber bar, and the spiral resilient portion selectively compresses or stretches.

6. The gas-free light bulb device as claimed in claim 1, wherein each filament assembly is a filament-shaped LED module.

7. The gas-free light bulb device as claimed in claim 1, wherein the heatsink is made of metal.

8. The gas-free light bulb device as claimed in claim 1, wherein the heatsink is made of aluminum.

9. The gas-free light bulb device as claimed in claim 1, wherein the heatsink is made of copper.

10. The gas-free light bulb device as claimed in claim 1, wherein the heatsink is made of plastic.

11. A gas-free light bulb device comprising:

a lamp head;

a heatsink mounted on the lamp head and having a mounting slot defined in the heatsink; and a driver circuit board mounted in the mounting slot;

a bulb mounted on the heatsink and having a cavity defined in the bulb;

a glass core column mounted in the mounting slot of the heatsink and extending in the cavity of the bulb;

multiple filament assemblies suspended on the glass core column and indirectly electrically connected to the driver circuit board; and a resilient extending element mounted on the glass core column and having a resilient rubber sleeve mounted around the glass core column, wherein a thermal expansion coefficient of the resilient rubber sleeve is higher than a thermal expansion coefficient of the glass core column; and multiple resilient extending rubber bars formed on and protruding radially outward from the resilient rubber sleeve and corresponding to the multiple filament assemblies, and an outer end of each resilient extending rubber bar connected to a corresponding filament assembly;

wherein, when the gas-free light bulb device is not operated under room temperature, an inner diameter of the resilient rubber sleeve is not larger than an outer diameter of the glass core column such that the resilient rubber sleeve is mounted tightly on a lower position of the glass core column and is unable to slide, at the meantime, the resilient extending rubber bars are curved and apply resilient force to the filament assemblies and the resilient rubber sleeve.

12. The gas-free light bulb device as claimed in claim 11, wherein the glass core column has multiple wire sets mounted on the glass core column and corresponding to the multiple filament assemblies, and each wire set having an upper core wire mounted on a top end of the glass core column and connected to a top end of a corresponding filament assembly; and a lower core wire mounted on a bottom end of the glass core column and connected to a bottom end of the corresponding filament assembly.

13. The gas-free light bulb device as claimed in claim 11, wherein each resilient extending rubber bar has multiple wave-shaped resilient portions formed on the resilient extending rubber bar and connected to one another, and the wave-shaped resilient portions selectively compress or stretch.

14. The gas-free light bulb device as claimed in claim 11, wherein each resilient extending rubber bar has multiple Z-shaped resilient portions formed on the resilient extending rubber bar and connected to one another, and the Z-shaped resilient portions selectively compress or stretch.

15. The gas-free light bulb device as claimed in claim 11, wherein each resilient extending rubber bar has a spiral resilient portion formed on the resilient extending rubber bar, and the spiral resilient portion selectively compresses or stretches.

16. The gas-free light bulb device as claimed in claim 11, wherein each filament assembly is a filament-shaped LED module.

17. A gas-free light bulb device comprising:

a lamp head;

a heatsink mounted on the lamp head and having a mounting slot defined in the heatsink; and a driver circuit board mounted in the mounting slot;

a bulb mounted on the heatsink and having a cavity defined in the bulb;

a glass core column mounted in the mounting slot of the heatsink and extending in the cavity of the bulb;

multiple filament assemblies suspended on the glass core column and indirectly electrically connected to the driver circuit board; and a resilient extending element mounted on the glass core column and having a resilient rubber sleeve mounted around the glass core column, wherein a thermal expansion coefficient of the resilient rubber sleeve is higher than a thermal expansion coefficient of the glass core column; and multiple resilient extending rubber bars formed on and protruding radially outward from the resilient rubber sleeve and corresponding to the multiple filament assemblies, and an outer end of each resilient extending rubber bar connected to a corresponding filament assembly;

wherein, when the gas-free light bulb device is operated with rising temperature, the resilient rubber sleeve is heated and expanded to make an inner diameter of the resilient rubber sleeve larger than an outer diameter of the glass core column, at the meantime, the resilient rubber sleeve is loosened relative to the glass core column, and resilient force of the resilient extending rubber bar drives the resilient rubber sleeve to slide upward along the glass core column to an upper position of the glass core column and to pivot the multiple filament assemblies upward relative to the glass core column until the bottom end of each filament assembly contacts the bulb an inner wall of the cavity and conducts heat of each filament assembly to the bulb.

18. The gas-free light bulb device as claimed in claim 17, wherein the glass core column has multiple wire sets mounted on the glass core column and corresponding to the multiple filament assemblies, and each wire set having an upper core wire mounted on a top end of the glass core column and connected to a top end of a corresponding filament assembly; and a lower core wire mounted on a bottom end of the glass core column and connected to a bottom end of the corresponding filament assembly.

19. The gas-free light bulb device as claimed in claim 17, wherein each resilient extending rubber bar has multiple wave-shaped resilient portions formed on the resilient extending rubber bar and connected to one another, and the wave-shaped resilient portions selectively compress or stretch.

20. The gas-free light bulb device as claimed in claim 17, wherein each resilient extending rubber bar has multiple Z-shaped resilient portions formed on the resilient extending rubber bar and connected to one another, and the Z-shaped resilient portions selectively compress or stretch.

* * * * *